United States Patent [19]

Chen

[11] Patent Number: 5,069,333

[45] Date of Patent: Dec. 3, 1991

[54] NAMECARD HOLDER AND DISPENSER

[76] Inventor: Chien J. Chen, No. 12, Chungshan Rd., Tanshui Chen, Taipei Hsien, Taiwan

[21] Appl. No.: 661,349

[22] Filed: Feb. 28, 1991

[51] Int. Cl.[5] ..... A45C 11/18; B65D 83/12

[52] U.S. Cl. ..... 206/39.5; 150/147

[58] Field of Search ..... 206/39, 39.5; 150/147

[56] References Cited

U.S. PATENT DOCUMENTS

| | | | |
|---|---|---|---|
| 794,415 | 7/1905 | Low | 206/39.5 |
| 1,155,737 | 10/1915 | Kinzie | 206/39.5 |
| 1,261,077 | 4/1918 | Walsh | 206/39.5 |
| 1,415,276 | 5/1922 | Terner | 206/39.5 |
| 3,286,823 | 11/1966 | Gillespie | 206/39.5 |
| 3,421,658 | 1/1969 | Cooksey | 206/39.5 |
| 3,710,929 | 1/1973 | Morales | 206/39.5 |
| 4,301,917 | 11/1981 | Ancell | 206/39.5 |
| 4,674,628 | 6/1987 | Prinsloo et al. | 206/39 X |

*Primary Examiner*—William I. Price

*Attorney, Agent, or Firm*—Browdy and Neimark

[57] ABSTRACT

A holder and dispenser for namecards has two rectangular plates with a chamber between the plates and an opening in each one. One side of the holder has a slot and slopes arranged to allow the insertion of a namecard and to prevent a namecard within the chamber from falling out, and another side of the holder has a slot and slopes arranged to allow the removal of a single namecard.

6 Claims, 3 Drawing Sheets

NAMECARD HOLDER AND DISPENSER

BACKGROUND OF THE INVENTION

The present invention relates to a namecard holder, and more particularly, to a namecard holder that also dispenses namecards.

Namecards are carried to distribute to business contacts or personal acquaintances. A supply of namecards is usually kept in a wallet or pocketbook. This has the inconvenience of carrying a supply of business namecards in a personal article, making the wallet or pocketbook a burden to carry. Sometimes the namecards are kept in a briefcase. Here the inconvenience lies in that the entire briefcase has to be opened to get out a single card, wasting time and being cumbersome.

Conventional namecard holders are designed to overcome the above nuisances. The designs provide namecard holders as an individual unit to be carried separately from a wallet, pocketbook, or briefcase. Generally the holders have a body to hold the namecards and a cover attached with a hinge. To obtain a card, the user must open the cover and pick out a card by hand. This operation usually requires the use of both hands, thereby temporarily inconveniencing the user. Also, if the holder is dropped, there is a high probability of all the namecards dispersing therefrom.

Therefore, it is clear that there has existed an unfulfilled need in the related art for a namecard holder and dispenser which conveniently holds namecards for distribution and easily dispenses the namecards.

SUMMARY OF THE INVENTION

The present invention provides a namecard holder of the type which is adapted to hold namecards and then easily dispense them, comprising a pair of rectangular plates with an opening in each and a chamber therebetween, and insertion means in a side thereof, and a dispensation means in another side thereof.

In order to ease the insertion of namecards into the chamber of the holder, the insertion means has a slot substantially the length or width of a namecard and one or two sloped surfaces to guide the namecard into the chamber. Accordingly, the dispensation means has a slot substantially the length or width of a namecard and one or two sloped surfaces to facilitate the removal of only one namecard at a time.

The design of the namecard holder and dispenser securely holds a supply of namecards: the namecards are unable to dislodge from the holder, even if dropped. The holder is conveniently sized, just slightly larger than an average namecard, so that it can be comfortably carried in a pants, breast, or jacket pocket. Furthermore, the present invention allows a single namecard to be handed to another party with the use of only one of the user's hands.

These and various other advantages and features of novelty which characterize the namecard holder and dispenser are pointed out with particularity in the claims annexed hereto and forming a part hereof. However, for a better understanding of the invention, its advantages, and the objects obtained by its use, reference should be made to the drawings which form a part hereof, and to the accompanying descriptive matter, in which there is illustrated and described a preferred embodiment of the invention.

DESCRIPTION OF THE PREFERRED EMBODIMENTS

Figure 1:
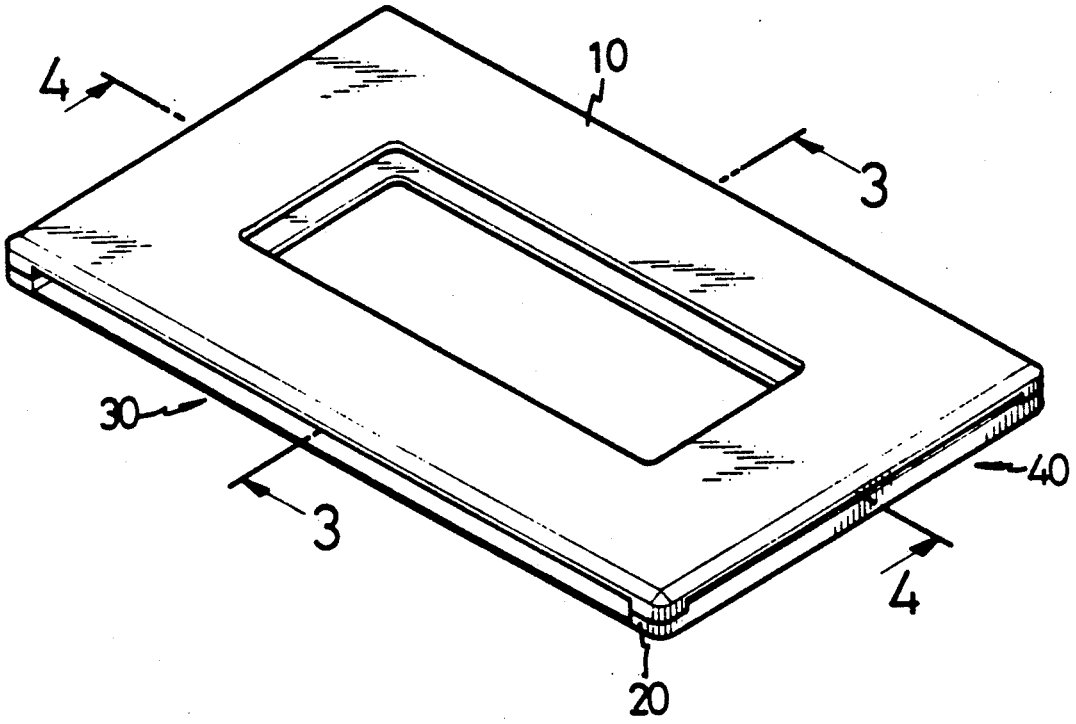
FIG. 1 is a perspective view of a namecard holder and dispenser according to a preferred embodiment of the present invention.

Referring to the drawings, and particularly to FIG. 1, a namecard holder and dispenser is shown according to a preferred embodiment. The holder generally comprises a top plate 10 and a bottom plate 20 releasably fixed together, forming an inner chamber therebetween. The holder further comprises an insertion means 30 for guiding the insertion of a namecard into the chamber of the holder, shown disposed in a first side thereof, and a dispensation means for guiding the dispensation of a namecard from the chamber, shown disposed in an adjacent first end thereof.

Figure 2:
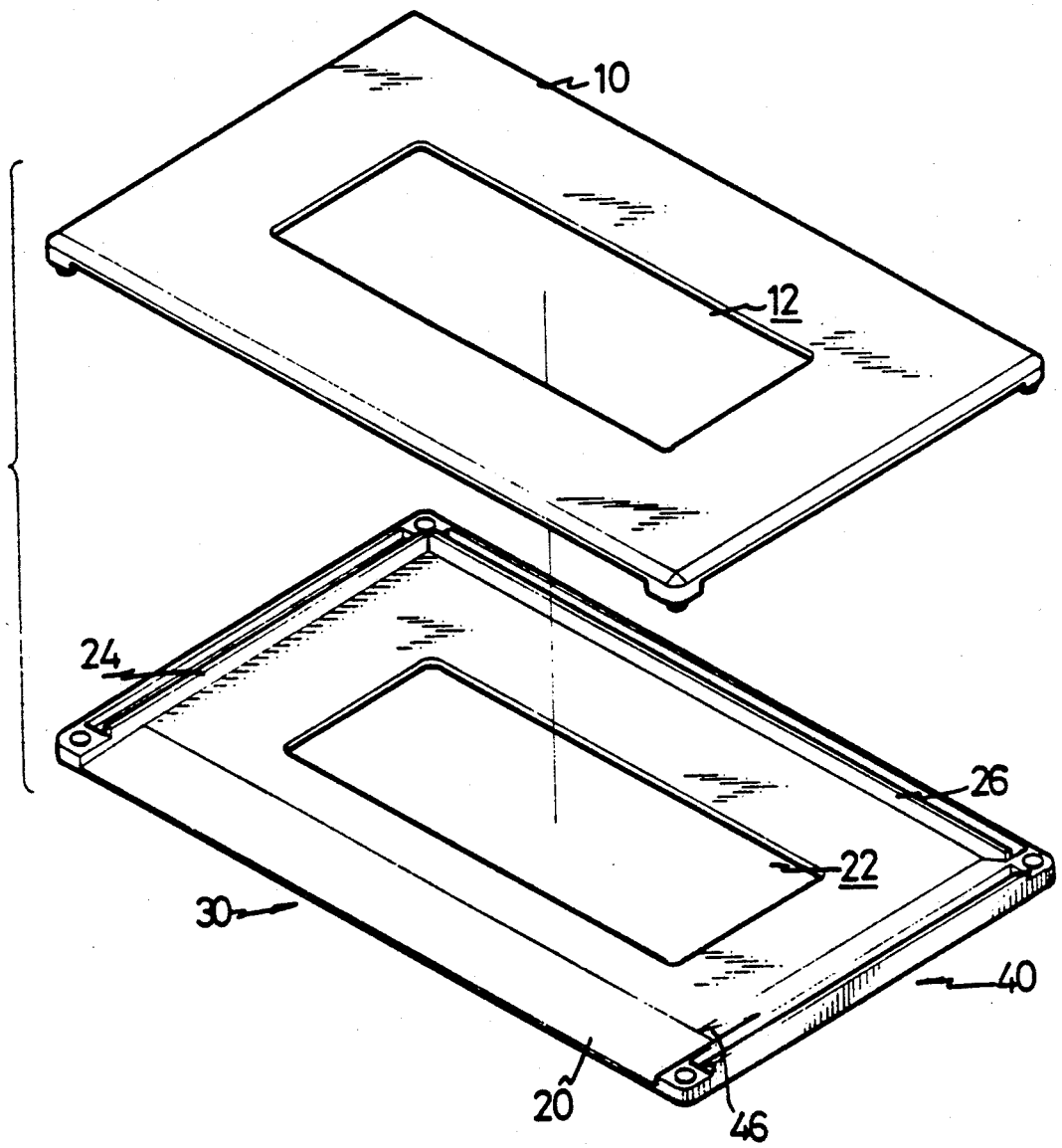
FIG. 2 is an explode view of FIG. 1, showing an internal structure of the present invention.
Figure 3:
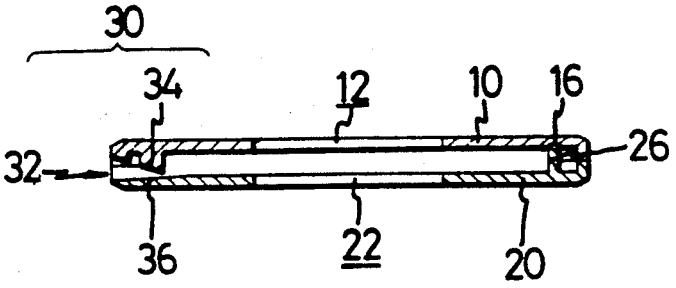
FIG. 3 is a cross-sectional view according to a preferred embodiment taken at line 3—3 of FIG. 1.
Figure 4:
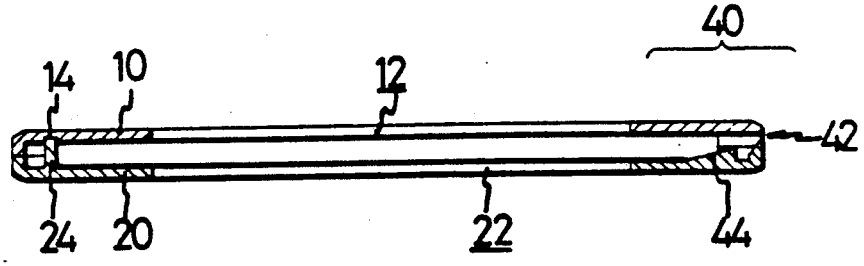
FIG. 4 is a cross-sectional view according to a preferred embodiment taken at line 4—4 of FIG. 1.

Now referring to FIGS. 2, 3, and 4, the top plate 10 comprises a top opening 12 centrally positioned therein, an end channel 14 disposed at a second end of the holder opposite the first end thereof, and a side channel 16 disposed at a second side of the holder opposite the first side thereof. The bottom plate 20 comprises a bottom opening 22 centrally positioned therein, an end wall 24 perpendicularly disposed at the second end of the holder, and a side wall 26 perpendicularly disposed at the second side of the holder.

When the top and bottom plates 10 and 20 are fixed together, the end channel 14 and side channel 16 respectively receive the end wall 24 and side wall 26. This engagement prevents namecards from becoming wedged between top surfaces of the walls 24 and 26 and an inside surface of the top plate 10, hindering the removal of a namecard. Also, the height of the walls 24 and 26 allows a supply of namecards to be received flush within the chamber of the holder.

Now referring more attentively to FIG. 3, the insertion means 30 comprises an insertion slot 32 substantially the length of the namecard, running from the end wall 24 of the second end to the dispensation means 40 of the first end; a primary insertion slope 34 disposed on the inside surface of the top plate 10, running the length of the insertion slot 32 therewithin; and a secondary insertion slope 36 disposed opposite the primary insertion slope 34 on an inside surface of the bottom plate 20, also running the length of the insertion slot 32 therewithin.

The slope of the primary insertion slope 34 is greater than that of the secondary insertion slope 36, while the run, slope being defined as rise over run, of the secondary insertion slope 36 is greater than that of the primary insertion slope 34. Also, the peak of the primary insertion slope 34 is in the same plane as an inside surface of the bottom plate 20. These structural characteristics of the insertion means 30 insures that a namecard can be easily inserted into the chamber of the holder. Also, after a supply of namecards is already in the chamber, the next subsequent namecard to be inserted into the holder will always be positioned on the bottom of the supply, i.e., flush with the inside surface of the bottom plate 20.

Another characteristic of the primary insertion slope 34 to be noted is an inside surface thereof, i.e., a surface in a plane parallel to the side wall 26, retains the supply of namecards within the chamber of the holder, not allowing any to exit through the insertion slot 32.

Now referring more attentively to FIG. 4, the dispensation means 40 comprises a dispensation slot 42 substantially the width of a namecard, running from the side wall 26 of the second side to the insertion means 30 of the first side; and a dispensation slope 44 disposed on the inside surface of the bottom plate 20, running the length of the dispensation slot 42 therewithin.

The width of the dispensation slot 42, i.e., the distance from the inside surface of the top plate 10 to the peak of the dispensation slope 42, is substantially the thickness of a namecard. This insures that only one namecard can be dispensed at one time.

Also, if the chamber of the namecard holder is substantially the same size of a namecard, minimizing the overall size of the holder. In this case, an end of the supply of namecards will rest on, and therefore be slightly lifted by, the dispensation slope 44. The dispensation slope 44 has a small transverse slope 46 (cf. FIG. 2) disposed in an end thereof proximate to the insertion slot 32 of the insertion means 30. It is insured that the transverse slope 46 guides an end of a namecard being inserted through the insertion slot 32 to be properly positioned on a lower portion of the dispensation slope 44, rather than abutting an otherwise blunt end thereof.

Accordingly, with a namecard holder and dispenser vacant of namecards in hand, a user has two possible methods to supply the holder with namecards: (1) to separate the top and bottom plates 10 and 20; place a supply of namecards on the inside surface of the bottom plate 20; tidy the namecards against the end and side walls 24 and 26; and refix the top and bottom plates 10 and 20; or (2) keep the top and bottom plates 10 and 20 fixed and simply insert namecards one by one through the insertion slot 32, using a finger inserted through the bottom opening 22 to urge the namecards to be flush against the side wall 26 (and the end wall 24). Once the supply of namecards is inserted into the chamber of the holder, they are securely retained therein.

With this supplied namecard holder and dispenser in hand, a user can dispense namecards one by one through the dispensation slot 42 of the dispensation means 40, using a finger inserted through the top opening 12 to urge a namecard out of the chamber of the holder. This operation can be done with the use of only one hand, holding the namecard holder and dispenser across the fingers of the hand and using the thumb to urge the namecard out.

The design of the present invention is particularly useful when receiving and handing out namecards at the same time. As namecards are received from other parties, they are inserted into the namecard holder, taking a position at the bottom of the user's supply of namecards, while the user's namecards are easily dispensed from the top of the supply. To retrieve the received namecards later, the top and bottom plates 10 and 20 are simply separated.

It is to be understood, however, that even though numerous characteristics and advantages of the present invention have been set forth in the foregoing description, together with details of the structure and function of the invention, the disclosure is illustrative only, and changes may be make in detail, especially in matters of shape, size, and arrangement of parts within the principles of the invention to the full extent indicated by the broad general meaning of the terms in which the appended claims are expressed.

I claim:

1. A namecard holder and dispenser, comprising:

a substantially rigid and rectangular body defined by: a first plate and a second plate with an inner chamber formed therebetween opening to a first side portion and a second side portion; a first opening in said first plate; and a second opening in said second plate;

an insertion means formed in said first side portion for guiding, in conjunction with a user's finger inserted through said second opening, a namecard into said chamber and for preventing a namecard within said chamber from falling out; and a dispensation means formed in said second side portion for guiding, in conjunction with a user's finger inserted through said first opening, only one namecard out of said chamber at a time.

2. The namecard holder and dispenser as claimed in claim 1, wherein said insertion means comprises:

an insertion slot along a length of said first side portion;

a primary insertion slope disposed in said insertion slot and formed on an inside surface of said first plate, increasing from an external end of said insertion slot to an internal end of said insertion slot and from said inside surface of said first plate to approximately an inside surface of said second plate; and a secondary insertion slope disposed in said insertion slot and formed in an inside surface of said second plate, opposite said primary insertion slope, increasing from said external end of said insertion slot to said internal end of said insertion slot, said secondary insertion slope terminating at a location further internal to a peak of said primary insertion slope;

whereby a distance between said peak of said primary insertion slope and said inside surface of said second plate is slightly greater than a thickness of a namecard, so that as a namecard is inserted into said insertion slot, said primary and secondary insertion slopes will guide and urge the namecard to be flush with said inside surface of said second plate, enabling a user's finger inserted through second opening to urge the namecard to be fully received into said chamber.

3. The namecard holder and dispenser as claimed in claim 2, wherein said peak of said primary insertion slope lies substantially in an imaginary plane defined by said inside surface of said second plate so that a namecard last received into said chamber is flush with said inside surface of said second plate, having a side of the namecard abutting a height of said primary insertion slope, thereby preventing the namecard last received into said chamber from falling out of said chamber through said insertion slot.

4. The namecard holder and dispenser as claimed in claim 1, wherein said dispensation means comprises:

a dispensation slot along a length of said second side portion; and a primary dispensation slope disposed in said slot and formed on an inside surface of said second plate, increasing from an internal end of said dispensation slot to an external end of said dispensation slot and from said inside surface of said second plate to approximately an inside surface of said first plate;

whereby a distance between a peak of said primary dispensation slope and said inside surface of said first plate is slightly greater than a thickness of a namecard, permitting only one namecard at a time to be dispensed from said chamber through said dispensation slot by a user's finger inserted through said first opening.

5. The namecard holder and dispenser as claimed in claim 4, wherein:

said first and second side portions are adjacent;

said chamber is substantially the size of a namecard; and said dispensation slope has a transverse slope disposed on an end thereof proximate to said first side portion, said transverse slope will guide an end of a namecard inserted through the insertion means to rest on a lower portion of said dispensation slope, preventing the end of the namecard from abutting said end of said dispensation slope.

6. The namecard holder and dispenser as claimed in claim 1, wherein:

said first and second side portions are adjacent;

one of said first or second plates has a first wall opposite said first side portion and a second wall opposite said second side portion, both said walls being perpendicularly disposed on an inside surface thereof; and the other said first or second plate has a first channel corresponding to said first wall and a second channel corresponding to said second wall, both said channels being rectilinearly disposed in an inside surface thereof so that when said first and second plates are fixed, said first and second walls respectively engage into said first and second channels, preventing a namecard from being wedged between top surfaces of said walls and said inside surface of the other said first or second plate.

* * * * *